US005964625A

United States Patent [19]

Farley

[11] Patent Number: 5,964,625

[45] Date of Patent: Oct. 12, 1999

[54] SPRING LOADED COMBINATION ELECTRICAL BINDING POST

[75] Inventor: David W. Farley, American Fork, Utah

[73] Assignee: Hart Scientific, Inc., American Fork, Utah

[21] Appl. No.: 09/067,605

[22] Filed: Apr. 28, 1998

[51] Int. Cl.[6] ..... H01R 4/48

[52] U.S. Cl. ..... 439/817; 439/908

[58] Field of Search ..... 439/817, 729, 439/908

[56] References Cited

U.S. PATENT DOCUMENTS

| | | | |
|---|---|---|---|
| 1,181,513 | 5/1916 | Ericson | 439/817 |
| 1,249,481 | 12/1917 | Phillips | 439/817 |
| 2,567,510 | 9/1951 | Drescher | 439/729 |
| 4,515,484 | 5/1985 | Gilley | 439/817 |
| 5,342,225 | 8/1994 | Farr | 439/817 |

*Primary Examiner*—Steven L. Stephan
*Assistant Examiner*—Javaid Nasri
*Attorney, Agent, or Firm*—Thorpe, North & Western, L.L.P.

[57] ABSTRACT

An electrical connection device or binding post (10) for forming electrical connections with various types of electrical connectors has a body (24) adapted for being disposed in an aperture (14) of a mounting panel (18). A head (26) is movably disposed in a cavity (74) of the body and a collar (28) is movably disposed about the body. A spring (32) biases the head and collar in a secured position while depression of the head defines an open position. One or more bores (100) in the head align with one or more bores (78) in the body when the head is depressed for receiving a wire (108). An annular groove (130) is formed between the collar and a flange (86) on the body when the head is depressed for receiving a spade-type connector (138). The bores and groove are located in separate locations on the body so that the wire connection and spade connection do not physically interfere with one another. A longitudinal bore (112) is formed in the head for receiving a banana-type connector (114). The post body has two lower sections (56 and 58) with differing diameters forming a step or flange (68) therebetween. The lowest section (58) may be received within an aperture (62) on a circuit board (64) or ring terminal (200) for physical and electrical connection.

21 Claims, 9 Drawing Sheets

SPRING LOADED COMBINATION ELECTRICAL BINDING POST

BACKGROUND OF THE INVENTION

1. Field of the Invention

The present invention relates to an electrical connection device disposed in an aperture of a panel or the like for forming an electrical connection with wires, spade-type terminals, banana-type connectors, circuit boards, ring terminals, and the like. More particularly, the present invention relates to a device having one or more holes for receiving wires, a bore for receiving a banana-type connector, and a space for receiving a spade-type terminal, each located at a different location on the device. In addition, the device has a first diameter disposed in the aperture of the panel and another diameter disposed in a circuit board or other connector, the two diameters forming a step or flange against which the circuit board or connector is held.

2. Prior Art

Electrical binding posts are common electrical components used to make temporary electrical connections between two or more electrical devices. The binding posts are typically mounted in a mounting panel with the lower portion of the binding post electrically connected to a first electrical device and the upper portion designed to receive one or more wires or other standard electrical connectors. A second electrical device may be electrically connected to the first device by connecting one or more wires or connectors to the binding posts.

The most common type of binding post includes a post for being disposed within a bore formed in a mounting plate, panel, or the like. The post includes an upper portion, which is usually accessibly above the mounting plate, and a lower portion, which is positioned below or behind the mounting plate. A flange is formed in the middle of the post. The lower portion of the post is threaded. The post is inserted in the bore of the plate with the flange disposed against the upper surface of the plate. A nut is threaded over the lower portion of the post and tightened against the lower surface of the plate. Thus, the post is secured to the plate by the flange and nut, which sandwich the plate between themselves. The tip of the lower portion has an annular indentation for receiving a hooked wire that may be soldered to the post. In addition, a second nut may be threaded over the lower portion of the post and a spade type connector secured between the two nuts. Connections made to the lower portion of the post are typically permanent, or semi-permanent, and are typically inaccessible to a user or remain unaltered by the user.

The upper portion of the post, however, is adapted for temporary and adjustable connections. A longitudinal bore is formed in the top of the upper portion of the post for receiving a banana-type connector. A nut is threadedly disposed on a threaded section of the upper portion of the post. The nut may be screwed to bear against the flange. Thus, the nut may be unscrewed, a spade type connector may be disposed between the nut and flange, and the nut screwed back towards the flange and spade type connector to secure the spade connector between the nut and flange. A bore is also formed traversly through the post just above the flange. Thus, the nut may be unscrewed, a bare wire inserted within the bore, and the nut screwed to secure the wire in the bore between the nut and flange.

One disadvantage with the above device is the amount of time and effort required to secure a wire or spade connector. The nut must be unscrewed and screwed to connect or release a wire or spade connector. Another disadvantage is that the device must secure the wire or the spade connector at the same location, between the nut and flange. Although it is possible to simultaneously connect a wire and spade connector, it is difficult to position and hold both the wire and spade connector while screwing or unscrewing the nut. In addition, while connecting a wire to an existing spade connection, it is possible for the wire to knock off the spade connector, or vice versa, because the connection must be loosened to make the additional connection. Another disadvantage with the above device is that it only provides for a single wire connection. Multiple wire connections can only be accomplished to the extent that they all fit in the single bore. In addition, the multiple wires may cause one or more of the wires to be insufficiently connected, so that it may come loose later.

Another disadvantage is that the nut may not be removed from the upper portion because the upper portion is enlarged to accommodate the longitudinal bore. Thus, the nut may not be removed to service or repair the device. This requires that the entire device be removed to service the device. This in turn requires the permanent or semi-permanent connections formed on the lower portion of the post to be disconnected. Disconnecting the electrical connection to the lower portion is difficult because the wires are often soldered and because the lower portion is often located where it is difficult to reach.

Another disadvantage with the above device is that its color coding cannot be easily changed. The flange and nut on the upper portion are typically covered in plastic to insulate the device. In addition, the plastic is sometimes colored so that the devices may be color coded. The plastic, however, is fixedly attached to the nut and flange. Therefore, to change the color coding, the entire device must be removed and replaced with a device of the proper color. As discussed above, removing the device can be difficult.

Another disadvantage with the above device is that it is not suited for being disposed in differently sized bores. The post is usually formed in a number of diameters to suit standard sized holes. Thus, a number of differently sized devices must be stocked to suit the differently sized holes.

U.S. Pat. No. 1,181,513 issued May 2, 1916, to Ericson, discloses a spring loaded type binding post having a post for attachment in a bore. The post has a longitudinal bore and a slot formed along the bore. A body is movably disposed on the post. The body is maintained on the shaft by a washer fixedly attached at the upper end of the post. A plunger has a shaft movably disposed in the bore and a head extending out of the bore. The shaft is attached to the body by a pin. The body and plunger are biased by a spring. Thus, by depressing the head of the plunger, the body is moved downwardly along the post. A spade type connector may be disposed between the body and the washer and secured when the head is released.

One disadvantage of the above device is that it does not provide for any other type of connecter, such as a banana type connector or bare wire. Presumably, a wire could be bent into a hook and connected as the spade connector. But the device is not designed for multiple connections. When the head is depressed to attach the hooked wire, the spade connector is released and may fall off or be knocked off by the wire. Another disadvantage is that the plunger and body may not be removed for service or repair because the washer is permanently attached to the post and prevents removal of the body.

U.S. Pat. No. 5,342,225, issued Aug. 30, 1994, to Farr, discloses a spring loaded type binding post having a post for being disposed in a bore. The post has an enlarged head. A body is movably disposed on the post and biased against the head by a spring. Depressing the body allows a wire to be disposed between the body and head and is secured when the body is released.

One disadvantage of the above device is that only one type of connector is provided for, a wire, although the device would presumably work with a spade type connector. In addition, the wire may be easily pulled loose because it is only held between the body and head. Another disadvantage is that the device may only be serviced or repaired by removing the entire device.

U.S. Pat. No. 1,249,481, issued Dec. 11, 1917, to Phillips, discloses a spring loaded type binding post having a post. A cap is movably disposed on the post and biased by a spring. Lifting the cap allows a spade type connector to be disposed between the cap and post and secured by the spring when the cap is released. A sleeve is also movably disposed on the post and biased by a spring. Depressing the sleeve allows another spade type connector to be secured. The two connectors, however, are insulated from one another.

One disadvantage of the above device is that it only provides for one type of connector, a spade connector. Although two spade connectors may be secured, they are electrically insulated from each other.

U.S. Pat. No. 2,567,510 issued Jan. 12, 1946, to Drescher, discloses a spring loaded type binding post having a post for attachment in a bore. A body is threadedly received over an upper portion of the post. The body may be turned to loosen or tighten the body against the post and to tighten the body against a spade type terminal connected between the post and the body. A cap is moveably disposed over the body and biased by a coiled spring disposed between the cap and the body. A first bore is formed in the side of the body and a second bore is formed in the side of the cap. The bores align when the cap is depressed against the biasing spring, allowing a wire to be inserted through both bores. When the cap is released, the spring forces the bores apart, securing the wire between the cap and body. A third bore extends through the top of the body and cap to receive a banana type plug.

One disadvantage of the above device is that the spring loaded cap only secures a wire to the post. A spade type terminal can only be secured to the post by unscrewing the cap and body from the post and then rescrewing the cap and body. This is a significant disadvantage if both a wire and spade terminal are connected to the post and it becomes necessary to remove the spade terminal because the cap and body, and thus the wire, must be turned to release the spade terminal, or the wire must first be removed.

Another disadvantage with the above device is that it may not be easily disassembled for service or repair. Although the cap and body may be unscrewed from the post, the cap is permanently attached to the body by indentations formed on the cap which nest in recesses formed in the body.

Another spring loaded type binding post made by Concord Electronics Corp., New York, N.Y., and identified as Part No. 01-1010-1-0210, has a post for being disposed in a bore. The post has an enlarged head and an annular groove formed in the post below the head. A cap is moveably disposed about the post and head and is biased. A slot is formed in the cap and aligns with the groove in the post when the cap is depressed. Thus, a wire or spade terminal may be secured between the slot in the cap and the head of the post.

One disadvantage of the above device is that it will not accept a banana type connector. Another disadvantage is that it may not be disassembled for repair or service because the cap is permanently fixed to the post.

Another disadvantage with many of the above devices is that the member that moves with respect to the post, such as the nut or cap or sleeve, is disposed on the outside of the post. Thus, as the member is pushed down it may catch on another wire, pulling it out of its connection, or it may get another wire caught in between, preventing it from depressing.

Therefore, it would be advantageous to develop an electrical binding post that can easily and quickly form an electrical connection between at least a wire and/or a spade-type terminal, and even a banana-type connector. It would also be advantageous to develop such a binding post where a spade-type terminal and a bare wire may be connected without physically interfering with each other. It would also be advantageous to develop such a binding post capable of directly connecting to a circuit board or ring terminal. In addition, it would be advantageous to develop such a binding post capable of connecting multiple wires without physically interfering with one another. It would also be advantageous to developed a binding post that may be disassembled for service and/or repair, and without requiring the post to be removed from the panel or permanent electrical connections to be disconnected. In addition, it would be advantageous to develop a binding post with a color coded scheme and that may be changed without removing the post. It would also be advantageous to develop a binging post capable of being disposed in different standard sized holes.

OBJECTS AND SUMMARY OF THE INVENTION

It is an object of the present invention to provide an electrical binding post that can easily and quickly form an electrical connection between several different kinds of standard connectors including a bare wire, a spade-type terminal, and a banana-type connector.

It is another object of the present invention to provide such a binding post where a spade-type terminal and a bare wire may be connected without physically interfering with each other.

It is yet another object of the present invention to provide such a binding post capable of directly connecting to a circuit board or ring terminal both physically and electrically.

It is yet another object of the present invention to provide a binding post capable of connecting multiple wires without physically interfering with one another.

It is yet another object of the present invention to provide a binding post that may be disassembled for service and/or repair, and without requiring the post to be removed from the panel or permanent electrical connections to be disconnected.

It is yet another object of the present invention to provide a binding post with an interchangeable, color coded scheme and that may be changed without removing the post.

It is a further object of the present invention to provide a binging post capable of being disposed in different standard sized holes.

These and other objects and advantages of the present invention are realized in an electrical connection device or spring loaded combination binding post having a post body, a head, a collar, a cap, a spring, a pin, a first nut, an adapter/first washer, a second washer, a second nut, and a third washer.

The device quickly and easily forms an electrical connection with various standard electrical connectors, such as a bare wire, a spade-type terminal, and/or a banana-type connector. The device is configured for being disposed in an aperture formed in a mounting panel or the like. The device may form electrical connections between various electrical components. Permanent or semi-permanent electrical connections are typically formed with the device behind or underneath the mounting panel to connect the device to a first electrical device.

The post body has an upper portion, configured for being disposed above the panel, and a lower portion, configured for being disposed through the aperture under the panel. The post body also has a first flange formed between the upper and lower portions to hold or maintain the post body on the panel.

The lower portion of the post body has a first threaded section adjacent the first flange with a first diameter preferably sized to be received in standard sized apertures. The lower portion of the post body also has a second threaded section adjacent the first section with a second diameter preferably sized for being received within a standard sized aperture of a circuit board or ring terminal. The second diameter of the second section is preferably smaller than the first diameter of the first section. Thus, a third flange or step is formed between the first and second sections.

The first nut is threadedly disposed on the first threaded section. The first nut may be tightened towards the first flange to secure the panel between the first flange and the first nut.

The post body has a longitudinal bore extending therein from the upper portion of the post body for receiving the head. A cavity is also formed in the upper portion of the post body for receiving the head. The post body also has one or more lateral bores extending laterally through the post body and into the cavity for receiving a wire. The post body preferably has at least one or two lateral bores so that multiple wires may be connected or a wire may be connected from a preferred direction.

The post body has a spade receiving section with a diameter sized to receive a spade-type terminal. The spade receiving section has a lateral surface or second flange against which the spade-type terminal is secured. The spade receiving section is located at a different position than the lateral bores so that a spade-type terminal may be connected at the spade receiving section while a bare wire is connected in the lateral bore without physically interfering with one another.

The head is movably disposed in the post body. The head has a button portion and a shaft portion. The button portion is disposed in the cavity of the post body. The shaft portion is disposed in the longitudinal bore of the post body. The head has one or more lateral bores formed in the button portion for receiving a wire.

The head is movable between a secured position and an open position. Electrical connections may be formed or broken when the head is in the open position while the electrical connections are maintained when the head is in the secured position. The lateral bores of the head align with the lateral bores of the post body when the head is in the open position for receiving a bare wire. The lateral bores of the head misalign with the lateral bores of the post body when the head is in secured position for securing the wire.

Multiple wires advantageously may be secured to the binding post because of the multiple lateral bores. In addition, a wire may be connected from a preferred direction or at multiple angles because the lateral bores are positioned around the binding post.

The spring bears against, or applies a force against, the shaft portion of the head. Thus, the spring biases the head in the secured position and provides a force for maintaining the wire connection.

The head also has a longitudinal bore extending therein from the button portion which is configured to receive banana-type connector.

The annular collar is movably disposed around the post body. In addition, the annular collar is coupled to the shaft portion of the head by the pin. Thus, as the head moves between the secured and open positions, the collar also moves between a secured position and an open position. The collar has an upper surface which is generally disposed opposite the lateral surface or second flange of the post body against which a spade-type terminal is secured. The surface of the collar and the second flange of the post body form a space or annular groove therebetween when the collar is in the open position. The annular groove is configured for receiving a spade-type terminal.

The collar is movable between a secured position and an open position. Electrical connections may be formed or broken when the collar is in the open position while electrical connections are maintained when the collar is in the secured position. The annular groove formed between the upper surface of the collar and the second flange of the post body is formed when the head, and thus the collar, is in the open position. The collar is biased in the secured position by the spring.

Therefore, a wire or spade terminal may be secured to or released from the binding post by pressing against the button portion of the head. Furthermore, the spade-type terminal and the wire do not physically interfere with one another.

Preferably, the pin is removably disposed in lateral bores of the collar and head so that the pin may be removed and the head and spring removed from the post body. Therefore, the binding post may be serviced and/or repaired without having to remove the post body from the mounting panel and without having to disconnect any electrical connections formed on the lower portion of the post body behind the panel.

The adapter/first washer may be disposed adjacent the first flange of the post body between the flange and the panel to provide electrical insulation. The adapter/first washer may have an aperture portion with an outer diameter that is larger than the first section of the post body to fill in the aperture of the panel, and thus adapt the smaller diameter of the post body to fit the larger aperture of the panel. Therefore, one post body may be used for various sized apertures.

Another wire or spade terminal may be connected to the lower portion of the post body by connecting the wire or spade terminal between the first nut and the second washer. Alternatively, the wire or spade terminal may be connected between the first nut and another nut which is also disposed on the first threaded section of the post body and tightened against the first nut.

The second nut is threadedly disposed on the second threaded section. The second nut may be tightened towards the third flange or step to secure the circuit board or ring terminal between the third flange or step and the second nut. Thus, the circuit board or ring terminal is secured to the binding post and an electrical connection formed therebetween.

The post body also has an annular groove formed on the end of the lower portion for receiving a wire soldered thereto.

Therefore, there are at least six possible electrical connections that may be formed with the binding post. A wire may form a first electrical connection by being disposed in the lateral bores. A banana-type connector may form a second electrical connection by being disposed in the longitudinal bore. A spade-type connector may form a third electrical connection by being disposed in the annular groove. A circuit board and/or ring terminal may form a fourth electrical connection by being disposed on the post body. Another wire or spade-type terminal may form a fifth electrical connection by being secured between the first nut and the second washer or by being secured between the first nut and another nut. Another wire may form a sixth electrical connection by being soldered or clipped to the end of the post body.

The annular cap is disposed on the button portion of the head and is preferably colored to correspond to the intended use of the device. The annular cap is preferably detachably coupled to the head so that the cap can be removed. Therefore, another cap may be placed on the head to replace the first if the first is broken or otherwise needs replacing. In addition, another cap of another color may be placed on the head to change the color identification of the device. Furthermore, the caps may be interchanged without requiring the post body to be removed from the panel.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1B:
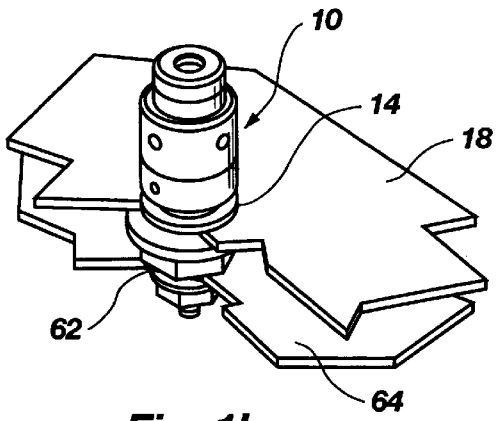
FIG. 1*b* is a perspective view of the preferred embodiment of the electrical connection device for forming electrical connections of the present invention disposed in the mounting panel.
Figure 1A:
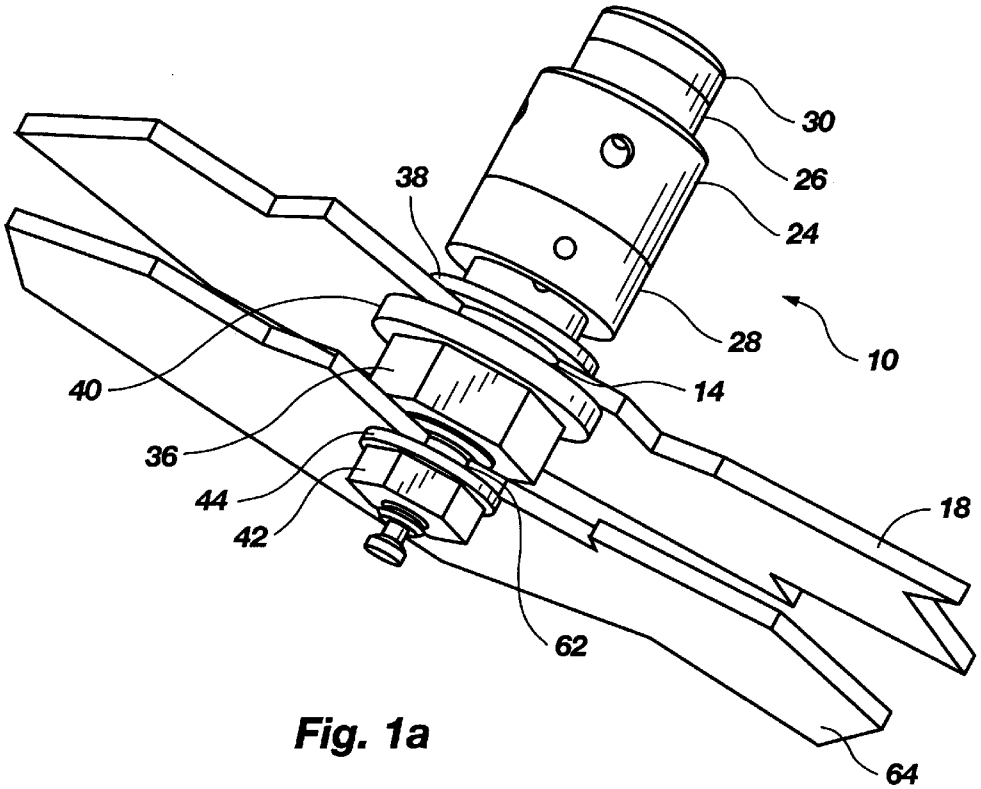
FIG. 1*a* is a perspective view of a preferred embodiment of an electrical connection device for forming electrical connections of the present invention disposed in a mounting panel.

As illustrated in FIGS. 1*a* and 1*b*, a preferred embodiment of an electrical connection device or spring loaded combination binding post, indicated generally at 10, for quickly and easily forming an electrical connection with various standard electrical connectors is shown. The device 10 may form electrical connections with a bare wire, a spade-type terminal, and/or a banana-type connector, as discussed more fully below. As shown, the device 10 is adapted for being disposed in an aperture 14 formed in a mounting panel 18 or the like. The mounting panel 18 is a surface on which one or more binding posts are mounted to form electrical connections between various electrical components (not shown). Permanent or semi-permanent electrical connections are typically formed with the binding post 10 behind or underneath the mounting panel 18 to connect the binding post 10 to a first electrical device (not shown).

Figure 3:
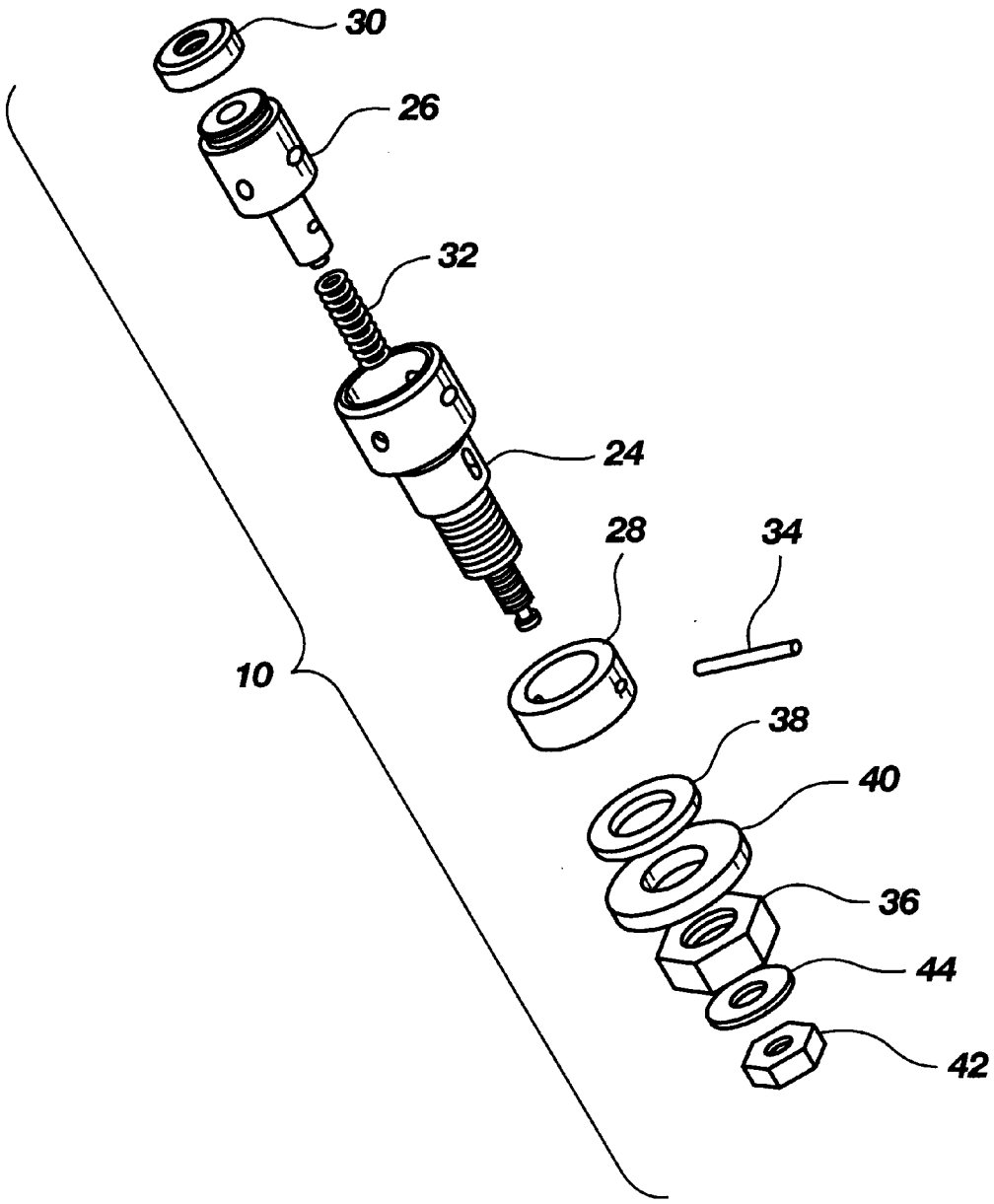
FIG. 3 is an exploded view of the preferred embodiment of the electrical connection device of the present invention.

Referring to FIGS. 1*a*, 1*b*, and 3, the device or binding post 10 generally has a post body 24, a head 26, a collar 28, a cap 30, a spring 32 (FIG. 3), a pin 34, a first nut 36, an adapter/first washer 38, a second washer 40, a second nut 42, and a third washer 44.

Figure 4:
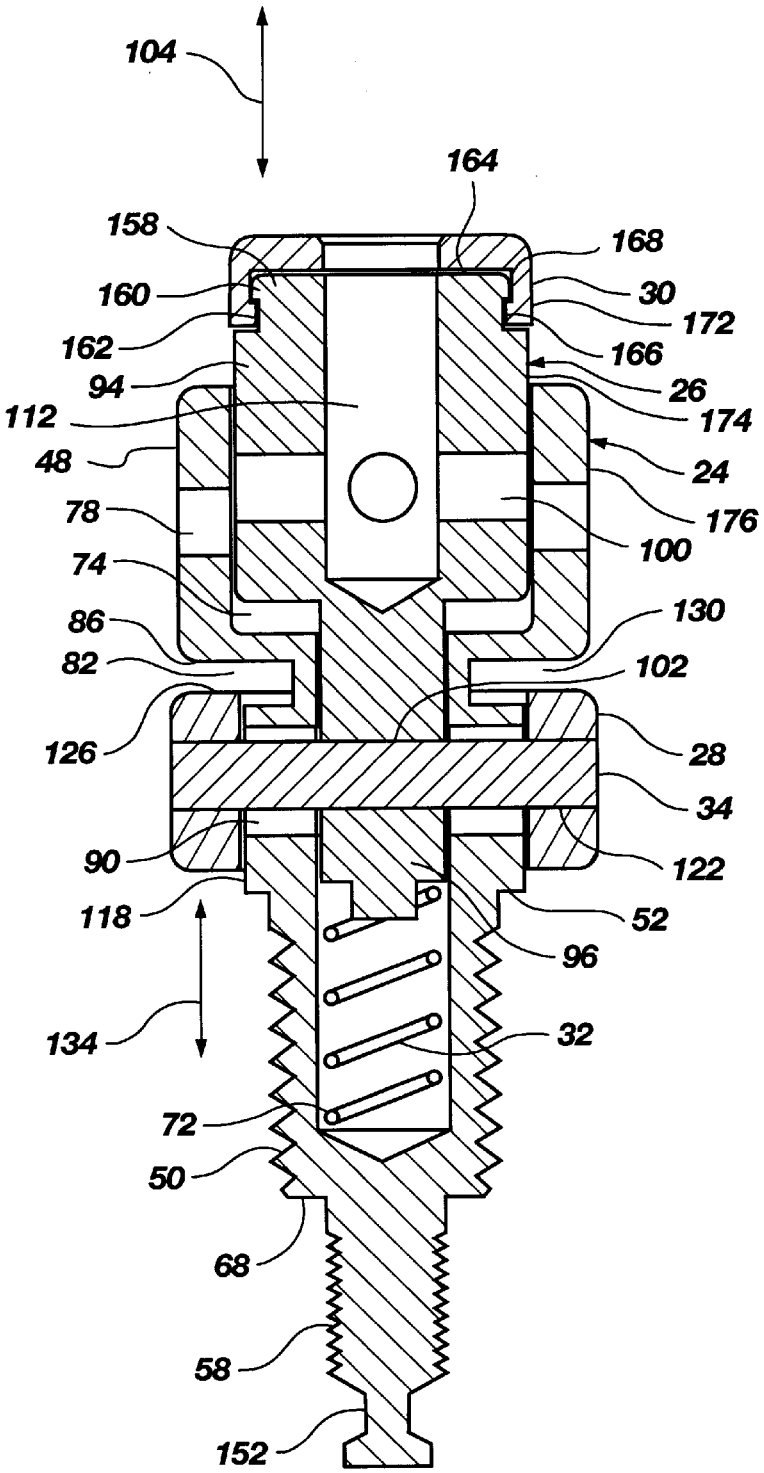
FIG. 4 is a cross sectional side view of the preferred embodiment of the electrical connection device of the present invention.
Figure 5A:
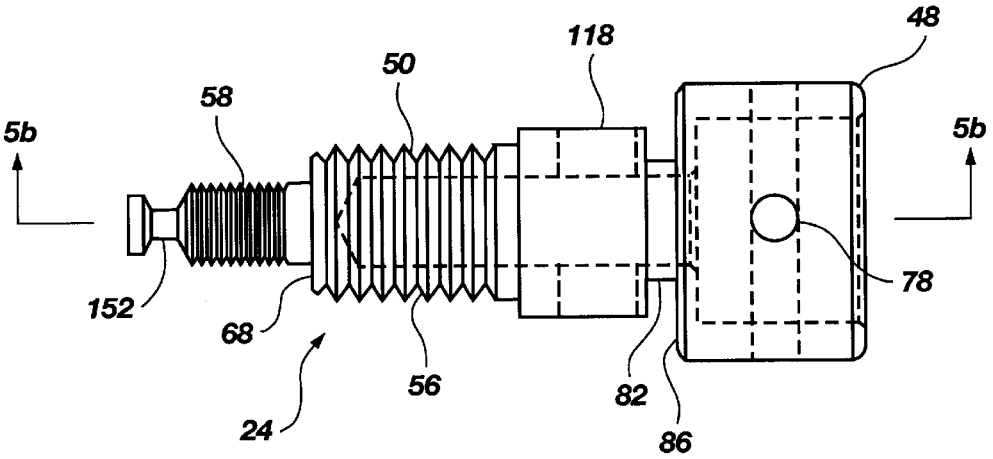
FIG. 5*a* is a side view of a post body of the preferred embodiment of the electrical connection device of the present invention.
Figure 5B:
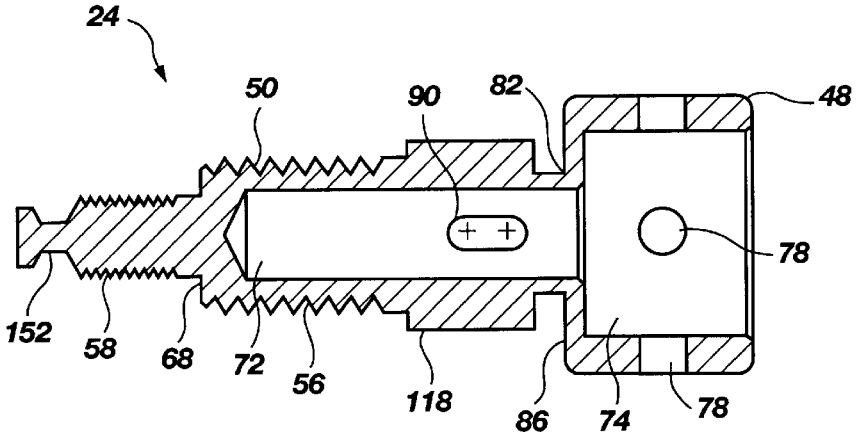
FIG. 5*b* is a cross sectional view of the post body of the preferred embodiment of the electrical connection device of the present invention taken along line 5*b*—5*b* of FIG. 5*a*.

Referring to FIGS. 4, 5*a* and 5*b*, the post body 24 is adapted for being disposed in the aperture 14 of the panel 18. The post body 24 is a generally symmetric, elongated member having sections of various diameters. The diameters of the sections of the post body generally decrease from the top of the post body to the bottom. Thus, the post body 24 may be inserted into the aperture 14 through the upper side of the mounting panel 18.

The post body 24 has an upper portion 48 and a lower portion 50. The upper portion 48 of the post body 24 is disposed above the mounting panel 18 and is adapted for receiving electrical connections. The lower portion 50 of the post body 24 is disposed below the mounting panel 18 and is also adapted to receive electrical connections. The post body 24 also has a first flange 52 formed between the upper and lower portions 48 and 50. The first flange 52 is disposed adjacent the panel 18 (or the adapter/first washer 38) to hold or maintain the post body 24 on the panel 18 with the upper portion 48 above the panel. Thus, the first flange 52 prevents the post body 24 from passing through the aperture 14.

The lower portion 50 of the post body 24 has a first threaded section 56 adjacent the first flange 52. The first section 56 has a first diameter that is preferably about 5/16 of an inch for being disposed through standard sized 3/8 of an inch diameter apertures in the panel 18. Alternatively, the first diameter may be about ½ of an inch for being disposed in standard ½ of an inch (or ½×0.48) apertures. It is of course understood that other sizes are possible.

The lower portion 50 of the post body 24 also advantageously has a second threaded section 58 adjacent the first section 56. The second section has a second diameter that is preferably sized for a standard #8 aperture for being received within a standard sized aperture 62 of a circuit board 64, as shown in FIGS. 1*a* and 1*b*. The second diameter of the second section 58 is preferably smaller than the first diameter of the first section 56. Thus, a third flange or step 68 is formed between the first and second sections 56 and 58. Therefore, the lower portion 50 of the post body 24 may advantageously be connected directly to a circuit board 64 or ring terminal, as discussed more fully below.

The first nut 36 is threadedly disposed on the first threaded section 56. The first nut 36 may be tightened towards the first flange 52 to secure the panel 18 between the first flange 52 and the first nut 36. Thus, the post body 24 is secured to the mounting panel 18.

The post body 24 has a longitudinal bore 72 extending therein from the upper portion 48 or top of the post body for receiving the head 26 as discussed more fully below. A cavity 74 is also formed in the upper portion 48 of the post body for receiving the head 26. The post body 24 also has one or more lateral bores 78 extending laterally through the post body 24 and into the cavity 74 for receiving a wire as discussed more fully below.

The post body 24 preferably has at least one or two lateral bores 78, more preferably has three or more bores, and most preferably has four lateral bores 78, as shown. Therefore, multiple wires may be connected or a wire may be connected from a preferred direction. It is of course understood that the post body may have any number of lateral bores to accommodate any number of wires.

The post body 24 has a spade receiving section 82 with a diameter sized to receive a spade-type terminal. The spade receiving section 82 may be an annular groove. The spade receiving section 82 also has a lateral surface or second flange 86 against which the spade-type terminal is secured, as discussed more fully below. The spade receiving section 82, or the second flange 86, advantageously is located at a different position than the lateral bores 78. Therefore, a spade-type terminal may be connected at the spade receiving section 82 while a bare wire is connected in the lateral bore 78 without physically interfering with one another.

The post body 24 also has a slot 90 extending laterally through the post body 24 and through the longitudinal bore 72. The slot 90 receives the pin 34 for coupling the head 26 to the collar 28 and for coupling the head 26 and collar 28 to the post body 24, as discussed more fully below. The slot 90 is elongated longitudinally, or along the length of the post body 24, so that the pin 34 may move up and down, or back and forth, within the slot, thus allowing the head 26 and collar 28 to move with respect to the post body.

Figure 6A:
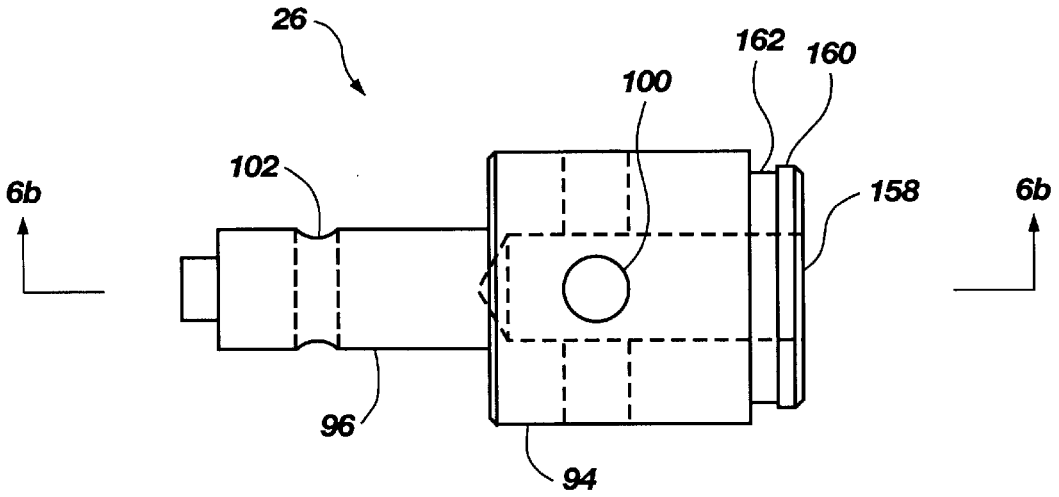
FIG. 6*a* is a side view of a head of the preferred embodiment of the electrical connection device of the present invention.
Figure 6B:
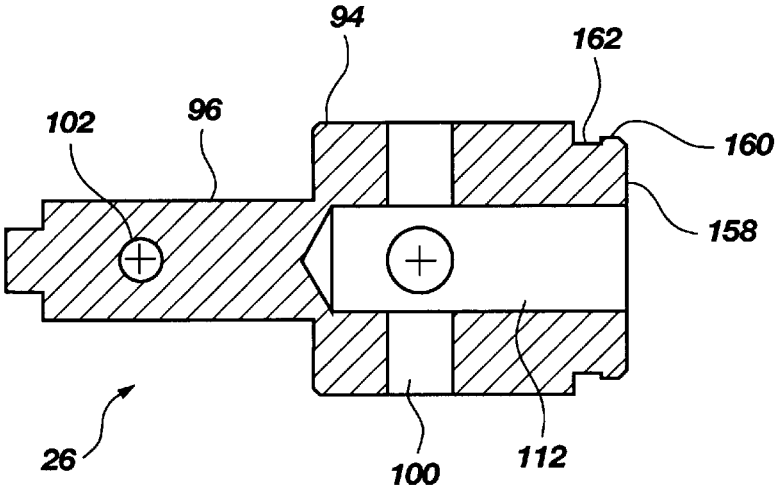
FIG. 6*b* is a cross sectional view of the head of the preferred embodiment of the electrical connection device of the present invention taken along line 6*b*—6*b* of FIG. 6*a*.

Referring to FIGS. 4, 6*a* and 6*b*, the head 26 is a generally symmetrical, elongated member with sections of differing diameters. A portion of the head 26 is movably disposed in the post body 24, as shown in FIG. 4. The head 26 has a button portion 94 and a shaft portion 96. The button portion 94 of the head 26 is adapted to be pushed against by a user. A portion of the button portion 94 is disposed in the cavity 74 of the post body 24. The button portion 94 or the head 26 nests in the cavity 74 or post body 24 and is laterally contained therein. The shaft portion 96 is disposed in the longitudinal bore 72 and cavity 74 of the post body 24.

The head 26 has one or more lateral bores 100 formed in the button portion 94 for receiving a wire. The head 26 preferably has at least one or two lateral bores 100, more preferably has three or more bores, and most preferably has four bores 100, as shown. The head may have any number of lateral bores. The head 26 also has another lateral bore 102 extending through the shaft portion 96 for receiving the pin 34.

Figure 2A:
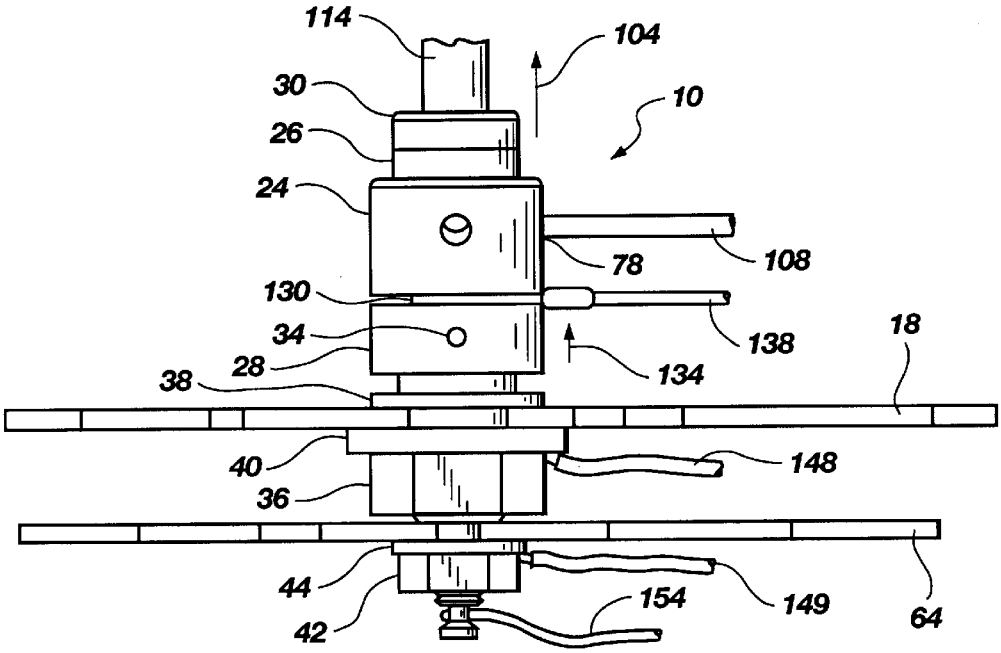
FIG. 2*a* is a side view of the preferred embodiment of the electrical connection device for forming electrical connections of the present invention shown in a secured position with various types of electrical connectors.
Figure 2B:
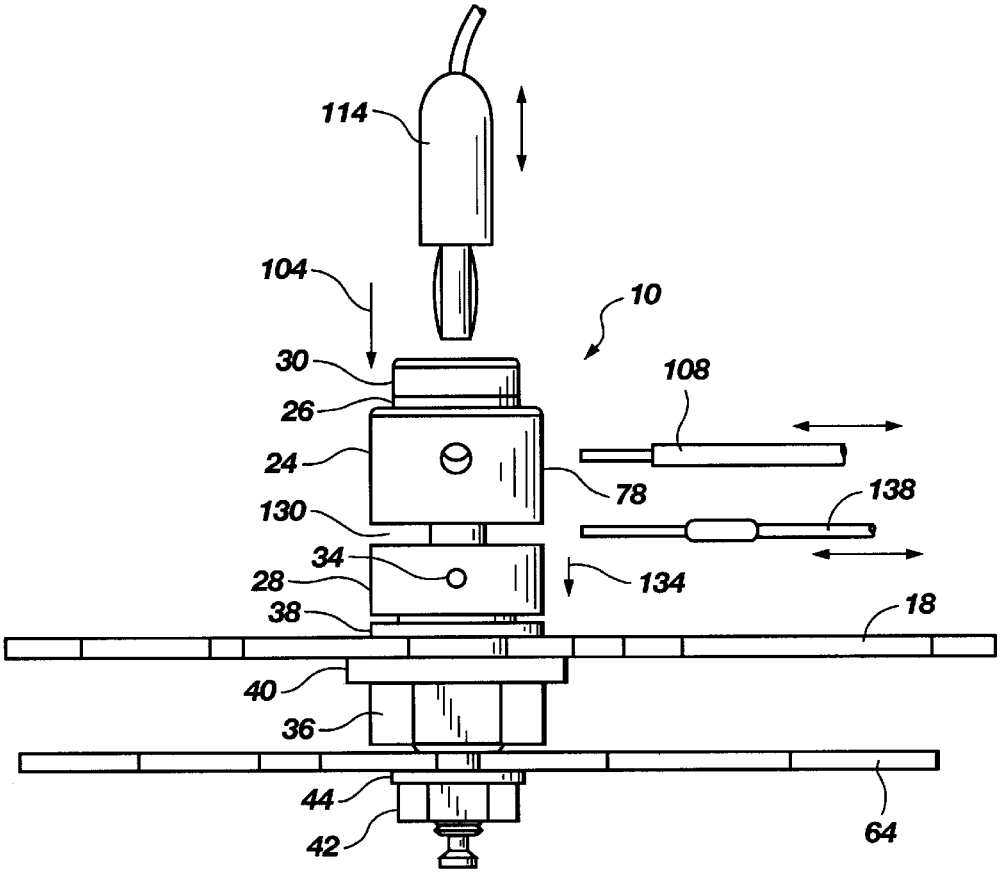
FIG. 2*b* is a side view of the preferred embodiment of the electrical connection device for forming electrical connections of the present invention shown in an open position with various types of electrical connectors.

Referring to FIGS. 2*a*, 2*b* and 4, the head 26 is movably disposed in the post body 24, as indicated by the arrow 104. The head is movable between a secured position, shown in FIG. 2*a*, and an open position, shown in FIG. 2*b*. Electrical connection may be formed or broken when the head is in the open position while the electrical connections are maintained when the head is in the secured position. The lateral bores 100 of the head 26 align with the lateral bores 78 of the post body 24 when the head 26 is in the open position for receiving a bare wire 108. Thus, the bare wire 108, as shown in FIG. 2*b*, may be inserted through, or withdrawn from, the lateral bores 78 and 100 in the post body 24 and head 26. The lateral bores 100 of the head 26 misalign with the lateral bores 78 of the post body 24 when the head 26 is in secured position for securing the wire 108. Thus, the bare wire 108, as shown in FIG. 2*a*, is secured in the post body 24 and head 26 between the lateral bores 78 and 100. The wire 108 secured in the bores defines an electrical connection between the post body, or the device, and the wire.

Multiple wires advantageously may be secured to the binding post 10 because of the multiple lateral bores 78 and 100. In addition, a wire may be connected from a preferred direction or at multiple angles because the lateral bores 78 and 100 are positioned around the binding post 10. Thus, the binding post 10 advantageously provides for multiple wire connections or connections from a desired direction because of the multiple bores disposed at various angles.

Referring again to FIG. 4, the spring 32 is disposed in the longitudinal bore 72 of the post body 24. The spring 32 bears against, or applies a force against, the shaft portion 96 of the head 26. Thus, the spring 32 biases the head 26 in the secured position and provides a force for maintaining the wire connection.

Referring to FIGS. 6*a* and 6*b*, the head 26 has a longitudinal bore 112 extending therein from the button portion 94 or top of the head. The longitudinal bore 112 is configured to receive a banana-type connector 114, as shown in FIG. 2*a*. The banana-type connector 114 disposed in the longitudinal bore 112 of the head 26 defines an electrical connection between the head, and thus the post body 24, and the banana-type connector.

Referring again to FIG. 4, the annular collar 28 is movably disposed around a shaft-like portion 118 of the post body 24. In addition, the annular collar 28 is coupled to the shaft portion 96 of the head 26 by the pin 34. Thus, as the head 26 moves between the secured and open positions, the collar also moves between a secured position and an open position, as shown in FIGS. 2*a* and 2*b*. The collar 28 has a lateral bore 122 extending therethrough for receiving the pin 34. The collar 28 has an upper surface 126 which is generally disposed opposite the lateral surface or second flange 86 of the post body 24 against which a spade-type terminal is secured. The surface 126 of the collar 28 and the second flange 86 of the post body 24 form a space or annular groove 130 therebetween when the collar 28 is in the open position. The annular groove 130 is configured for receiving a spade-type terminal.

Referring to FIGS. 2*a,* 2*b* and 4, the collar 28 is movably disposed around the post body 24, as indicated by the arrow 134. The collar 28, like the head 26, is movable between a secured position, shown in FIG. 2*a,* and an open position, shown in FIG. 2*b.* Electrical connections may be formed or broken when the collar is in the open position while electrical connections are maintained when the collar is in the secured position. The annular groove 130 formed between the upper surface 126 of the collar 28 and the second flange 86 of the post body 24 is formed when the head 26, and thus the collar 28, is in the open position. Thus, a spade-type terminal 138 may be inserted into or withdrawn from the annular groove 130 or from between the upper surface 126 of the collar 28 and the second flange 86 of the post body 24, as shown in FIG. 2*b.* The collar 28 is biased in the secured position by the spring 32. Thus, the surface 126 of the collar 28 is forced towards and against the second flange 86 of the post body 24 to secure the spade-type terminal 138 between them, as shown in FIG. 2*a.* The spade-type terminal 138 secured in the groove 130 defines an electrical connection between the post body, or the device, and the spade terminal.

Therefore, a wire 108 or spade terminal 138 may be secured to or released from the binding post 10 by pressing against the button portion 94 of the head 26. When the head 26 is depressed, or in the open position, the lateral bores 78 and 100 of the post body 24 and head 26 align so that a wire 108 may be inserted into or withdrawn from the bores. In addition, a spade terminal 138 may be inserted into or withdrawn from the groove 130 as the head 26 is depressed. When the head 26 is released, the spring 32 forces the head 26 and collar 28 into their secured positions. The lateral bores 78 and 102 of the post body 24 and head 26 misalign, securing the wire 108. In addition, the upper surface 126 of the collar 28 is forced against the second flange 86 of the post body 24. The spade terminal 138 is secured in the groove 130 between the surface 126 and the flange 86.

Furthermore, the spade-type terminal 138 and the wire 108 do not physically interfere with one another because the lateral bores 78 and 100 and the annular groove 130 are located at different position on the binding post 10. Thus, the head 26 may be depressed and a wire 108 inserted into or withdrawn from the lateral bores 78 and 100 without inadvertently bumping and disconnecting a spade terminal 138 connected at the groove 130. Likewise, a spade terminal 138 may be connected at the groove without inadvertently bumping and disconnecting a wire 108 connected in the bores 78 and 100. Depression of the head 26 advantageously allows for both wire and spade-type terminal connections to be made to the binding post without having to screw and unscrew a nut, as in prior art devices. In addition, a wire 108 and a spade terminal 138 may be easily connected to the binding post 10 because the lateral bores 78 and 100 and annular groove 130 are not in the same location, as in prior art devices.

The pin 34 is disposed in the lateral bores 122 and 102 of the collar 28 and head 26 to couple the collar to the head. The pin 34 is also movably disposed in the slot 90 of the post body 24 and moves within the slot 90 as the collar 28 and head 26 move between the secured and open positions. Preferably, the pin 34 advantageously is removably disposed in the lateral bores 122 and 102 so that the pin may be removed and the head 26 and spring 32 removed from the post body 24. Therefore, the binding post 10 may be serviced and/or repaired without having to remove the post body 24 from the mounting panel 18 and without having to disconnect any electrical connections formed on the lower portion 56 of the post body 24 behind the panel 18.

Figure 7A:
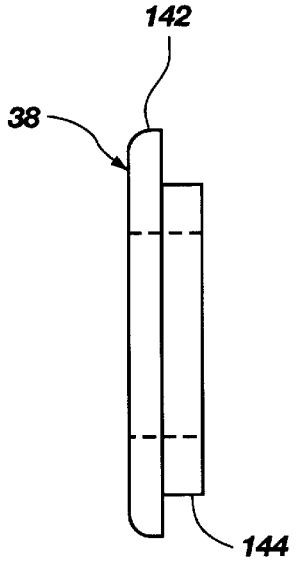
FIG. 7*a* is a side view of an adapter/washer of the preferred embodiment of the electrical connection device of the present invention.
Figure 7B:
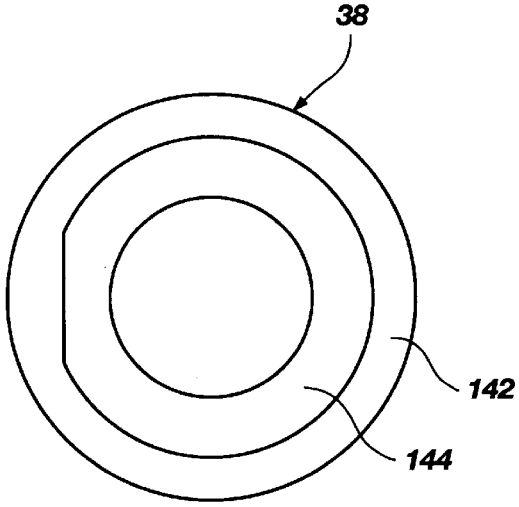
FIG. 7*b* is a bottom view of the adapter/washer of the preferred embodiment of the electrical connection device of the present invention.

Referring to FIGS. 1*a,* 1*b,* 2*a* and 2*b,* the adapter/first washer 38 may be disposed adjacent the first flange 52 of the post body 24 between the flange 52 and the panel 18. Referring to FIGS. 7*a* and 7*b,* the adapter/first washer 38 has a flange portion 142 and an aperture portion 144. The flange portion 142 is adapted for being disposed between the first flange 52 of the post body 24 and the panel 18. The aperture portion 144 is adapted for being disposed between the first section 56 of the post body 24 and the aperture 14 of the panel 18. The second washer 40 is disposed between the first nut 36 and the panel 18, as shown in FIGS. 1*a,* 1*b,* 2*a* and 2*b.* The adapter/first washer 38 and second washer 40 provide electrical insulation between the post body 24 and the panel 18.

It is of course understood that the adapter/first washer and second washer are just one example of an insulating means for electrically insulating the post body and the panel. Other insulating means are possible, such as a coating of insulative material applied to the post body, first nut, and/or panel; a panel made of an electrically-nonconductive material, such as plastic; etc.

The aperture portion 144 of the adapter/first washer 38 may have an outer diameter that is larger than the first section 56 of the post body 24, or be sized and configured to fit the aperture of the panel. Thus, the aperture portion 144 of the adapter/washer 38 may have an outer diameter just large enough to fit between the post body 24 and the aperture 14 of the panel 18, providing electrical insulation. Alternatively, the aperture portion 144 may have a larger diameter to fill in the aperture of the panel, and thus adapt the smaller diameter of the post body to fit the larger aperture of the panel. For example, the aperture portion 144 of the adapter/washer 38 may have an outer diameter of about ½ of an inch (or ½×0.46) to match a ½ of an inch diameter aperture in the panel and an inner diameter of about ⅜ of an inch for receiving a post body with a diameter of about ⅜ of an inch. Therefore, one post body, with a diameter of ⅜ of an inch, may be used for both ⅜ of an inch and ½ of an inch apertures in a panel. It is of course understood that other sizes are possible.

Referring to FIG. 2*a,* another wire, spade terminal 148, or ring terminal, may be connected to the lower portion 50 of the post body by connecting the wire, spade terminal 148, or ring terminal between the first nut 36 and the second washer 40. Alternatively, the wire, spade terminal, or ring terminal may be connected between the first nut 36 and another nut (not shown) which is also disposed on the first threaded section 56 of the post body 24 and tightened against the first nut. The other wire/spade terminal/ring terminal connection defines an electrical connection between the wire, spade terminal, or ring terminal and the post body or binding post.

Similarly, another wire, spade terminal 149, or ring terminal, may be connected to the lower portion 50 of the post body by connecting the wire, spade terminal 149, or ring terminal between the second nut 42 and the step 68. Alternatively, the wire, spade terminal, or ring terminal may be connected between the second nut 42 and another nut (not shown) which is also disposed on the second threaded section 58 of the post body 24 and tightened against the second nut. The other wire/spade terminal/ring terminal connection defines an electrical connection between the wire, spade terminal, or ring terminal and the post body or binding post.

The second nut 42 is threadedly disposed on the second threaded section 58. The second nut 42 may be tightened towards the third flange or step 68 to secure the circuit board 64 between the third flange or step 68 and the second nut 42. Thus, the circuit board 64 is secured to the binding post 24 and an electrical connection formed therebetween. The third flange or step 68 formed between the different diameters of the first and second sections 56 and 58 advantageously allows for the circuit board 64 to be directly and physically connected to the post body 24, as well as electrically connected to the post body. Thus, the circuit board connected to the post body defines an electrical connection between the circuit board and the binding post.

Figure 10:
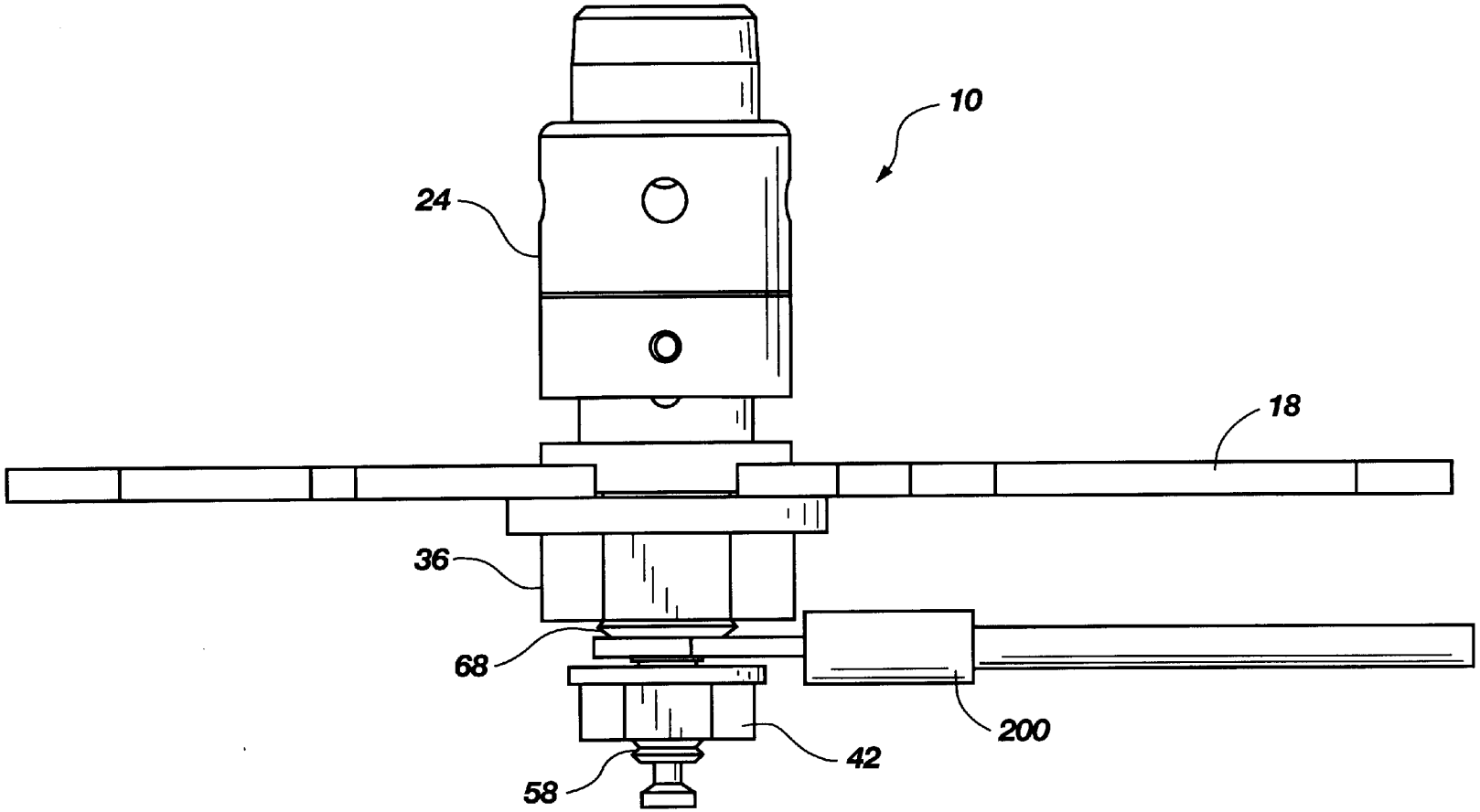
FIG. 10 is a side view of the preferred embodiment of the electrical connection device for forming electrical connections of the present invention shown in a secured position with various types of electrical connectors.

Referring now to FIG. 10, the second nut 42 may be tightened towards the third flange or step 68 to secure a ring terminal 200, as opposed to a circuit board, between the third flange or step 68 and the second nut 42. It is of course understood that the second nut 42 and step 68 may secure not only a ring terminal 200, but another connector such as a wire or spade terminal as well.

It is of course understood that the first and second diameters of the first and second sections of the post body may be sized for any particular panel aperture or circuit board aperture or connector aperture. It is also understood that the threaded sections are just one example of a fastening means for securing the panel and circuit board. Other means for securing the panel and circuit board to the post body include, for example, a resistance or press fit between the first and/or second sections and the panel and/or circuit board apertures. Other fastening means may include welding or soldering, resistance fit clips, resilient snap fit arms or wings that compress when inserted into the aperture and then snap back out to secure the post, etc.

Referring to FIGS. 5*a* and 5*b,* the post body 24 also has another annular groove 152 formed on the end of the lower portion 50. The annular groove 152 is configured for receiving another wire 154 soldered or clipped thereto. The wire 154 soldered to the end of the post body 24 defines an electrical connection, as shown in FIG. 2*a.*

Therefore, referring to FIG. 2*a,* there are at least six possible electrical connections that may be formed with the binding post 10. A wire 108 may form a first electrical connection by being disposed in the lateral bores 78 and 100. A banana-type connector 114 may form a second electrical connection by being disposed in the longitudinal bore 112. A spade-type connector 138 may form a third electrical connection by being disposed in the annular groove 130. A circuit board 64 may form a fourth electrical connection by being disposed on the post body 24. Similarly, a ring terminal 200 may form an electrical connection by being disposed on the post body 24 in place of the circuit board, as shown in FIG. 10. Another wire, spade-type terminal 148, or ring terminal may form a fifth electrical connection by being secured between the first nut 36 and the second washer 40 or by being secured between the first nut 36 and another nut (not shown). Another wire 154 may form a sixth electrical connection by being soldered or clipped to the end of the post body 24. Another wire, spade terminal 149, or ring terminal may form a seventh electrical connection by being secured between the second nut 42 and the step 68, or by being secured between the second nut 42 and another nut (not shown).

Referring to FIG. 4, the annular cap 30 is disposed on the button portion 94 of the head 26. The cap 30 is preferably colored to correspond to the intended use of the binding post 10. For example, the cap 30 may be green to indicate a ground connection, or red for a hot or live connection. The annular cap 30 is preferably detachably coupled to the head 26 so that the cap can be removed. Therefore, another cap may be placed on the head to replace the first if the first is broken or otherwise needs replacing. In addition, another cap of another color may be placed on the head to change the color identification of the binding post 10. Furthermore, the caps may be interchanged without requiring the post body 24 to be removed from the panel 18.

Figure 8A:
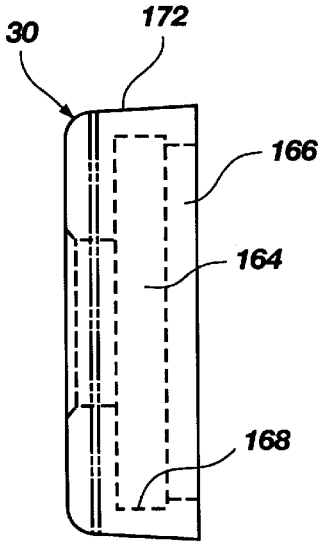
FIG. 8*a* is a side view of a cap of the preferred embodiment of the electrical connection device of the present invention.
Figure 8B:
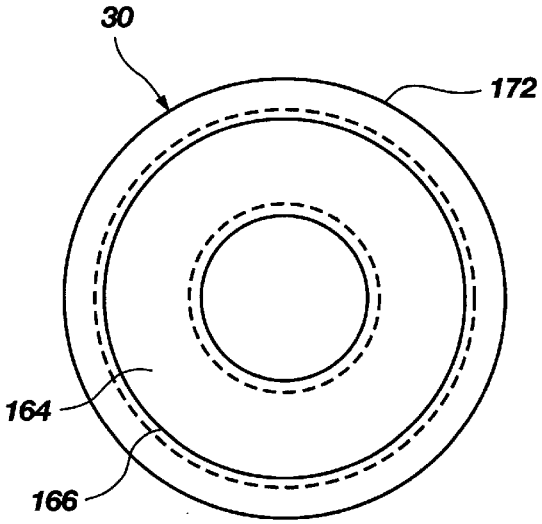
FIG. 8*b* is a bottom view of the cap of the preferred embodiment of the electrical connection device of the present invention.
Figure 9:
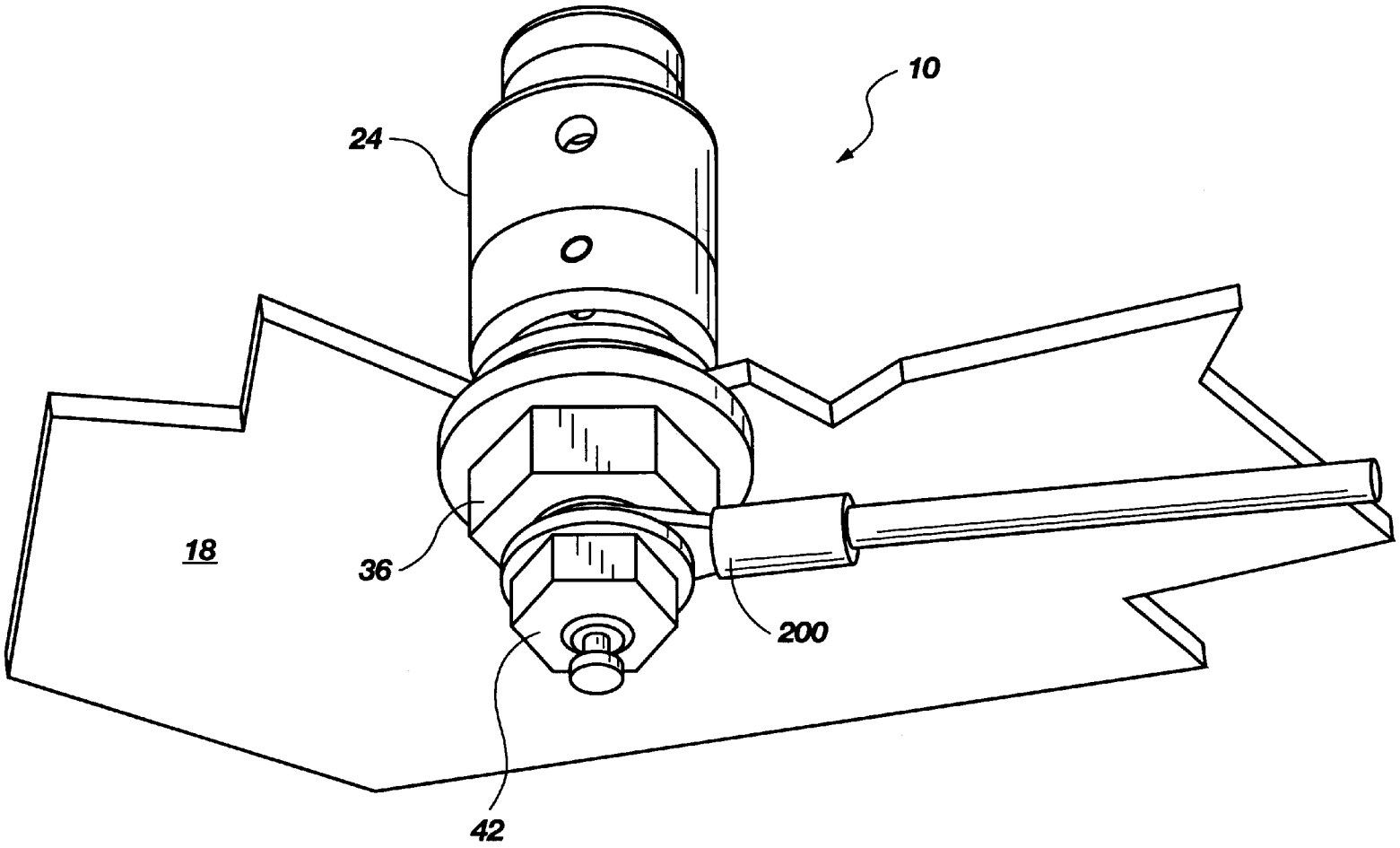
FIG. 9 is a perspective view of the preferred embodiment of the electrical connection device for forming electrical connections of the present invention disposed in the mounting panel.

Referring to FIGS. 4 and 6*a,* the head 26 has an annular lip 158 formed on the button portion 94, or on the top. An annular ridge 160 is formed around the lip 158 and projects outwardly forming an annular groove 162 between the ridge 160 and the head 26. Referring to FIGS. 4 and 8, the annular cap 30 has an annular indentation 164 for receiving the annular lip 158 of the head 26. An annular ridge or lip 164 is formed about the annular indentation 164 and projects inwardly forming an annular groove 168 for receiving the annular ridge 160 of the head 26. The cap 30 is preferably made of a resilient material that expands, allowing the annular ridge or lip 166 of the cap 30 to expand around the lip 158 and annular ridge 160 of the head 26 and then returning to its original shape and size with the annular ridge 166 of the cap 30 engaging the annular groove 162 of the head 26. Thus, the cap 30 may be easily and quickly removed and replaced.

The cap 30 has a side wall 172. The side wall 172 of the cap 30 may be flush with a side wall 174 of the head 26, as shown in FIG. 4. The flush profile of the cap wall 172 and head wall 174 prevents a wire or other object from catching on the cap 30 and inadvertently removing the cap 30 from the head 26. In addition, the flush profile prevents a wire or other object from becoming caught between the cap 30 and post body 24 and preventing depression of the head 26. Alternatively, the cap wall 172 may extend outwardly and/or be flush with a side wall 176 of the post body 24. The outwardly extending side wall 172 of the cap may prevent contact between the post body 24 and the user's finger, thus preventing electrical shock.

In addition, the cap 30 is preferably made of a plastic material, or other insulative material. Thus, the cap 30 provides an electrical insulation between the binding post 10 and a user's finger.

The post body 24, the head 26, and the collar 28 contain an electrically conductive material. Therefore, electrical connections made with the post body 24, head 26 and collar 28 are electrically connected to each other. Electrical connections made to the lower portion 50 of the post body 24, such as the wires and/or spade terminals 148 and 154 and the circuit board 64, are electrically connected to connections formed on the upper portion 48 of the post body 24, such as the wire 108, spade terminal 138, and/or banana connector 114. The post body 24, head 26, and collar 28 are preferably material plated to prevent corrosion and insure a good electrical connection. Therefore, the post body 24, head 26, and collar 28 may be brass with a gold plate finish or copper with a gold plate finish.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. An electrical connection device configured for forming an electrical connection with at least a wire and/or a spade-type terminal and configured for being disposed in an aperture formed in a panel, the device comprising:

an elongated post body configured for being disposed in the aperture of the panel and having a first flange for maintaining the post body on the panel, the post body having a first section with a first diameter for being disposed through the aperture of the panel, the post body having a cavity formed therein, the post body also having one or more lateral bores extending laterally into the cavity for receiving the wire, the post body also having a second first flange against which the spade terminal is secured;

a first fastening means disposed on the first section of the post body for securing the panel between the flange and the first fastening means and thus securing the post body to the panel;

a head moveably disposed in the cavity of the post body and movable between a secured position and an open position, the head having one or more lateral bores for receiving the wire, the lateral bores of the head aligning with the lateral bores of the post body when the head is in the open position for receiving the wire and misaligning when the head is in the secured position for securing the wire between the misaligned lateral bores to define a first electrical connection;

a biasing means disposed in the cavity of the post body and bearing against the head for biasing the head in the secured position; and a collar movably disposed on the post body and coupled to the head so that the collar moves between the secured position and the open position with the head, the collar being biased in the secured position by the biasing means, the collar having a surface opposite the second flange of the post body and against which the spade terminal is secured, a space formed between the second flange of the post body and the surface of the collar being configured for receiving a spade-type terminal, the surface and second flange securing the spade-type terminal therebetween when the collar is in the secured position to define a second electrical connection, the space for receiving the spade-type connector and the lateral bores for receiving the wire being in separate locations on the post body, to thereby provide for wire and/or spade-type terminal connections at the same time in separate locations and being able to secure and release the wire and/or spade-type terminal simply by depressing and releasing the head.

2. The device of claim 1, further comprising:

an insulator means disposed on the post body for electrically insulating the post body and fastening means from the panel.

3. The device of claim 1, further comprising:

an adapter means disposed on the post body and adapted to be received within a larger aperture on the panel for adapting the post body to be received with the larger aperture.

4. The device of claim 1, further comprising:

a cap detachably coupled to the head and being colored to correspond to an intended use so that the cap may be removed and another cap of another color coupled to the head, to thereby provide for interchangeable caps of different colors.

5. The device of claim 1, further comprising at least three lateral bores formed in the post body and at least three lateral bores formed in the head, to thereby provide for the connection of at least three wires or for the connection of a wire from at least three directions.

6. The device of claim 1, wherein the head is detachably coupled to the post body, thereby providing for service and/or repair without having to remove the post body from the panel.

7. The device of claim 1, further comprising:

a second section formed on the post body adjacent the first section with a second diameter configured for being received within an aperture of a circuit board or ring terminal, the second diameter of the second section and the first diameter of the first section forming a third flange therebetween; and a second fastening means disposed on the second section of the post body for securing the circuit board or ring terminal between the second fastening means and the third flange of the post body and thus securing the circuit board or ring terminal to the post body and forming an electrical connection therebetween, defining a third electrical connection.

8. The device of claim 7, further comprising:

a third fastening means disposed on the first section of the post body for securing a wire or spade-type terminal between the third and first securing means and thus forming an electrical connection defining a forth electrical connection.

9. The device of claim 8, further comprising:

an annular groove formed at the end of the post body and configured for receiving a wire soldered or clipped thereto, defining a fifth electrical connection.

10. The device of claim 9, further comprising:

a longitudinal bore extending therein and configured for receiving a banana-type connector to define a sixth electrical connection.

11. An electrical connection device configured for forming an electrical connection with at least a wire and/or another connector and configured for being disposed in an aperture formed in a panel, the device comprising:

an elongated post body having an upper portion configured for forming electrical connections and a lower portion adapted for being disposed through the aperture of the panel, the post body having a first flange for maintaining the post body on the panel, the lower portion having a first section with a first diameter for attaching the post body to the panel and a second section adjacent the first section with a second diameter configured for being received within an aperture of a circuit board or ring terminal, the upper portion of the post body having connection means for connecting the wire and/or other connector;

s first fastening means disposed on the first section of the post body for securing the post body to the panel;

a second fastening means disposed on the second section of the post body for securing the circuit board or ring terminal to the post body, to thereby secure the circuit board or ring terminal to the post body and forming an electrical connection therebetween.

12. The device of claim 11, wherein the first diameter of the first section and the second diameter of the second section of the post body form a step therebetween; and wherein the circuit board or ring terminal abuts the step and is secured between the step and the second fastening means.

13. An electrical connection device configured for forming an electrical connection with a wire, a spade-type terminal, and/or a banana-type connector and configured for being disposed in a aperture formed in a panel, the device comprising:

an elongated post body configured for being disposed in the aperture of the panel and having an upper portion adapted for forming electrical connections and a lower portion, the post body also having a first flange between the upper and lower portions for maintaining the post body on the panel, the lower portion having a first threaded section with a first diameter for being disposed through the aperture of the panel and a second threaded portion with a second diameter configured for being received within an aperture of a circuit board or ring terminal, the second diameter being smaller than the first diameter, the post body also having a longitudinal bore extending therein from the upper portion and a cavity formed in the upper portion, the upper portion also having one or more lateral bores extending laterally into the cavity for receiving the wire, the post body also having a second flange against which the spade terminal is secured, the post body also having a lateral slot extending therethrough and through the longitudinal bore;

a first nut threadedly disposed on the first threaded section of the post body for securing the panel between the first flange and the first nut and thus securing the post body to the panel;

a head moveably disposed in the cavity and the longitudinal bore of the post body and movable between a secured position and an open position, the head having a button portion disposed at least partially in the cavity and a shaft portion disposed at least partially in the longitudinal bore of the post body, the head having one or more lateral bores for receiving the wire, the lateral bores of the head aligning with the lateral bores of the post body when the head is in the open position for receiving the wire and misaligning when the head is in the secured position for securing the wire between the misaligned lateral bores to define a first electrical connection, the head having a longitudinal bore extending therein from the button portion and configured for receiving the banana-type connector to define a second electrical connection, the head also having a lateral bore extending through the shaft portion;

a spring disposed in the longitudinal bore of the post body and bearing against the shaft portion of the head to bias the head in the secured position;

an annular cap disposed on the button portion of the head and being colored to correspond to the intended use;

an annular collar movably disposed around the post body and coupled to the head so that the collar moves between the secured position and the open position with the head, the collar being biased in the secured position by the spring, the collar having a surface opposite the second flange of the post body and against which the spade terminal is secured, a space formed between the second flange of the post body and the surface of the collar being configured for receiving a spade-type terminal, the surface and second flange securing the spade-type terminal therebetween when the collar is in the secured position to define a third electrical connection, the space for receiving the spade-type connector and the lateral bores for receiving the wire being in separate locations on the post body, the collar also having a lateral bore extending therethrough; and a pin disposed in the lateral bores of the collar and the shaft of the head for coupling the collar to the head, the pin also being movably disposed within the slot of the post body and moving therein as the collar and head move between the secured and open positions, to thereby provide for wire, spade-type terminal, and banana-type connector connections at the same time in separate locations and being able to secure and release the wire and/or spade-type terminal simply by depressing and releasing the head.

14. The device of claim 13, further comprising:

a first washer disposed adjacent the first flange of the post body and having a flange portion and an aperture portion, the flange portion configured for being disposed between the first flange of the post body and the panel, the aperture portion configured for being disposed in the aperture of the panel between the aperture and the post body; and a second washer disposed adjacent the first nut and configured for being disposed between the first nut and the panel, to thereby provide electrical insulation between the post body and the panel.

15. The device of claim 13, further comprising:

an annular lip formed on the button portion of the head; and an annular indentation formed in the cap and configured for receiving the annular lip of the head to secure the cap to the head.

16. The device of claim 13, wherein the cap is detachably coupled to the head so that the cap may be removed and another cap of another color coupled to the head, to thereby provide for interchangeable caps of different colors.

17. The device of claim 13, further comprising at least three lateral bores formed in the post body and at least three lateral bores formed in the head, to thereby provide for the connection of at least three wires or for the connection of a wire from at least three directions.

18. The device of claim 13, wherein the pin is removably disposed in the lateral bores of the collar and the shaft of the head so that the pin may be removed and the head and spring removed from the post body, thereby providing for service and/or repair without having to remove the post body from the panel.

19. The device of claim 13, further comprising:

a second nut threadedly disposed on the second threaded section of the post body for securing the circuit board or ring terminal between the second nut and the post body and thus securing the circuit board or ring terminal to the post body and forming an electrical connection therebetween, defining a fourth electrical connection.

20. The device of claim 19, further comprising:

an annular groove formed at the end of the post body on the lower portion and configured for receiving a wire soldered or clipped thereto, defining a sixth electrical connection.

21. The device of claim 14, wherein the aperture portion of the first washer has a diameter that is larger than the first diameter of the first threaded section of the post body, to thereby allow the post body to be received within a larger aperture in the panel.

* * * * *